US012311242B2

(12) United States Patent
Berkowitz et al.

(10) Patent No.: US 12,311,242 B2
(45) Date of Patent: May 27, 2025

(54) YARD GAME

(71) Applicant: BHR Innovations LLC, Smyrna, GA (US)

(72) Inventors: Brian Berkowitz, Smyrna, GA (US); David Hale, Marietta, GA (US); Jeff Reilly, Smyrna, GA (US)

(73) Assignee: BHR Innovations LLC, Smyrna, GA (US)

( * ) Notice: Subject to any disclaimer, the term of this patent is extended or adjusted under 35 U.S.C. 154(b) by 822 days.

(21) Appl. No.: 17/494,143

(22) Filed: Oct. 5, 2021

(65) Prior Publication Data

US 2022/0105403 A1 Apr. 7, 2022

Related U.S. Application Data

(60) Provisional application No. 63/087,635, filed on Oct. 5, 2020.

(51) Int. Cl.
*A63B 67/06* (2006.01)

(52) U.S. Cl.
CPC ..... *A63B 67/06* (2013.01); *A63B 2067/063* (2013.01)

(58) Field of Classification Search
CPC ..... A63B 67/00; A63B 67/06; A63B 67/066; A63B 2067/063; A63B 71/02; A63B 61/003; A63B 2243/00
See application file for complete search history.

(56) References Cited

U.S. PATENT DOCUMENTS

| | | | | |
|---|---|---|---|---|
| 5,074,556 | A * | 12/1991 | Loeppky | A63F 7/0668 D21/339 |
| 9,993,720 | B1 * | 6/2018 | Carroll | A63F 7/36 |
| 11,969,635 | B1 * | 4/2024 | Basyuk | A63B 63/00 |
| 2004/0178584 | A1 * | 9/2004 | Fairbanks | A63B 67/06 273/400 |
| 2007/0049430 | A1 * | 3/2007 | Hatfalvi | A63B 67/04 473/496 |
| 2009/0017947 | A1 * | 1/2009 | Jones | A63B 61/003 473/494 |
| 2016/0045799 | A1 * | 2/2016 | Gallagher | A63B 63/007 273/335 |
| 2016/0325164 | A1 * | 11/2016 | Brooks | A63B 71/02 |
| 2019/0030419 | A1 * | 1/2019 | Carroll | A63F 3/00214 |
| 2019/0232136 | A1 * | 8/2019 | Krause | A63B 67/04 |
| 2020/0238143 | A1 * | 7/2020 | Howell | A63B 67/06 |
| 2021/0291027 | A1 * | 9/2021 | Krause | A63B 71/022 |

(Continued)

FOREIGN PATENT DOCUMENTS

WO WO-2005044398 A1 * 5/2005 ..... A63B 61/003

*Primary Examiner* — Raleigh W Chiu
(74) *Attorney, Agent, or Firm* — Buchalter, a Professional Corporation

(57) ABSTRACT

A method for playing a game includes positioning a shield of the game between a first target box of a first team and a second target box of a second team, the game further including at least one target of the first team and at least one projectile; positioning the at least one target of the first team in the first target box by a first player of the first team in a target setup step; positioning a second player of the second team in a second team throwing position; and throwing a projectile of the at least one projectile at the first target box by the second player while positioned in the second team throwing position.

7 Claims, 10 Drawing Sheets

(56) References Cited

U.S. PATENT DOCUMENTS

| | | | | |
|---|---|---|---|---|
| 2022/0105403 | A1* | 4/2022 | Berkowitz | A63B 61/02 |
| 2023/0271071 | A1* | 8/2023 | Filippini | A63B 59/40 473/475 |

* cited by examiner

YARD GAME

CROSS-REFERENCE TO RELATED APPLICATIONS

This application claims the benefit of U.S. Provisional Application 63/087,635, filed on Oct. 5, 2020, which is hereby incorporated in its entirety by reference.

TECHNICAL FIELD

This disclosure relates to games. Specifically, this disclosure relates to yard games.

BACKGROUND

People enjoy playing outdoor games in their yards, at parking lots during tailgate parties, or on the beach. Games provide a fun way to pass the time and promote social interaction.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a method for playing a game comprising positioning a shield of the game between a first target box of a first team and a second target box of a second team, the game further comprising at least one target of the first team and at least one projectile; positioning the at least one target of the first team in the first target box by a first player of the first team in a target setup step; positioning a second player of the second team in a second team throwing position wherein the second player is positioned behind the second target box of the second team; the shield is positioned between the second player and first target box; and the shield blocks a line of sight of the second player from seeing the first target box and the at least one target of the first team; and throwing a projectile of the at least one projectile at the first target box by the second player while positioned in the second team throwing position.

Also disclosed is a shield comprising a frame comprising a top bar; a first leg assembly coupled to the top bar, the first leg assembly comprising a first leg and a second leg, the first leg and the second leg being pivotable relative to the top bar, the first leg comprising an attachment mechanism; and a second leg assembly coupled to the top bar opposite from the first leg assembly; and a visibility screen comprising a complimentary attachment mechanism configured to engage with the attachment mechanism of the first leg to couple the visibility screen to the frame.

Also disclosed is a target comprising a body defining a top end and a bottom end, the body defining a noisemaker cavity between the top end and the bottom end; and a noisemaker positioned within the noisemaker cavity, the noisemaker configured to emit an audible sound in response to a triggering event.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
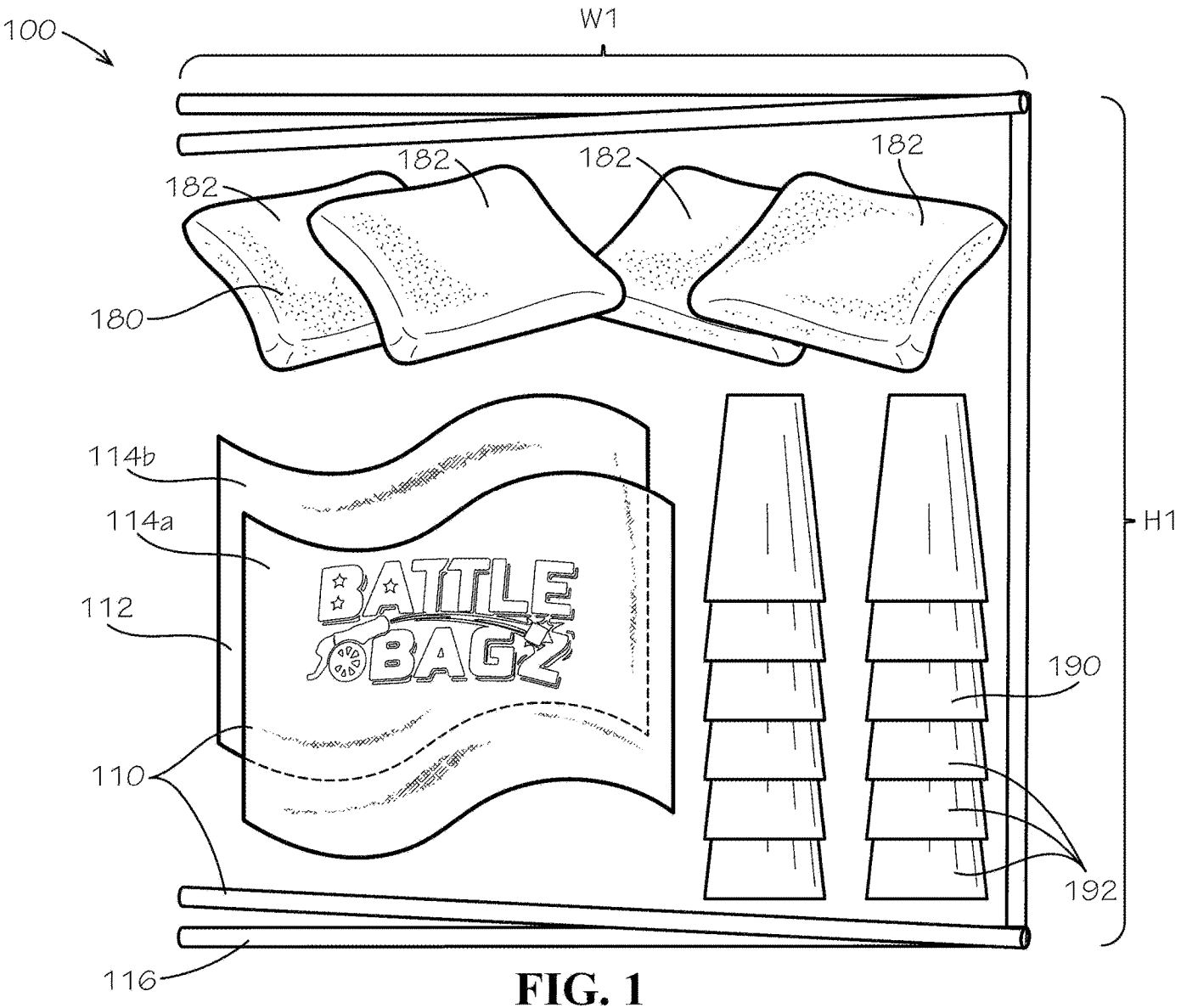
FIG. 1 is a top view of a game comprising a shield, at least one projectile 180, and at least one target in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed, that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a game and associated methods, systems, devices, and various apparatus. The yard game can comprise a shield, at least one target, and at least one projectile. It would be understood by one of skill in the art that the disclosed game is described in but a few exemplary aspects among many. No particular terminology or description should be considered limiting on the disclosure or the scope of any claims issuing therefrom.

FIG. 1 is a top view of a game 100 comprising a shield 110, at least one projectile 180, and at least one target 190. The game 100 is shown in a disassembled state, wherein the game 100 can define a width W1 and a height H1. In the present aspect, the width W1 can be two feet and the height H1 can be two feet. In some aspects, the width W1 can be larger or smaller than two feet, such as between one foot and four feet for example and without limitation. In some aspects, the height H1 can be larger or smaller than two feet, such as between one foot and four feet for example and without limitation. The disassembled state can be spatially optimized for shipping and storage of the game 100.

Figure 6:
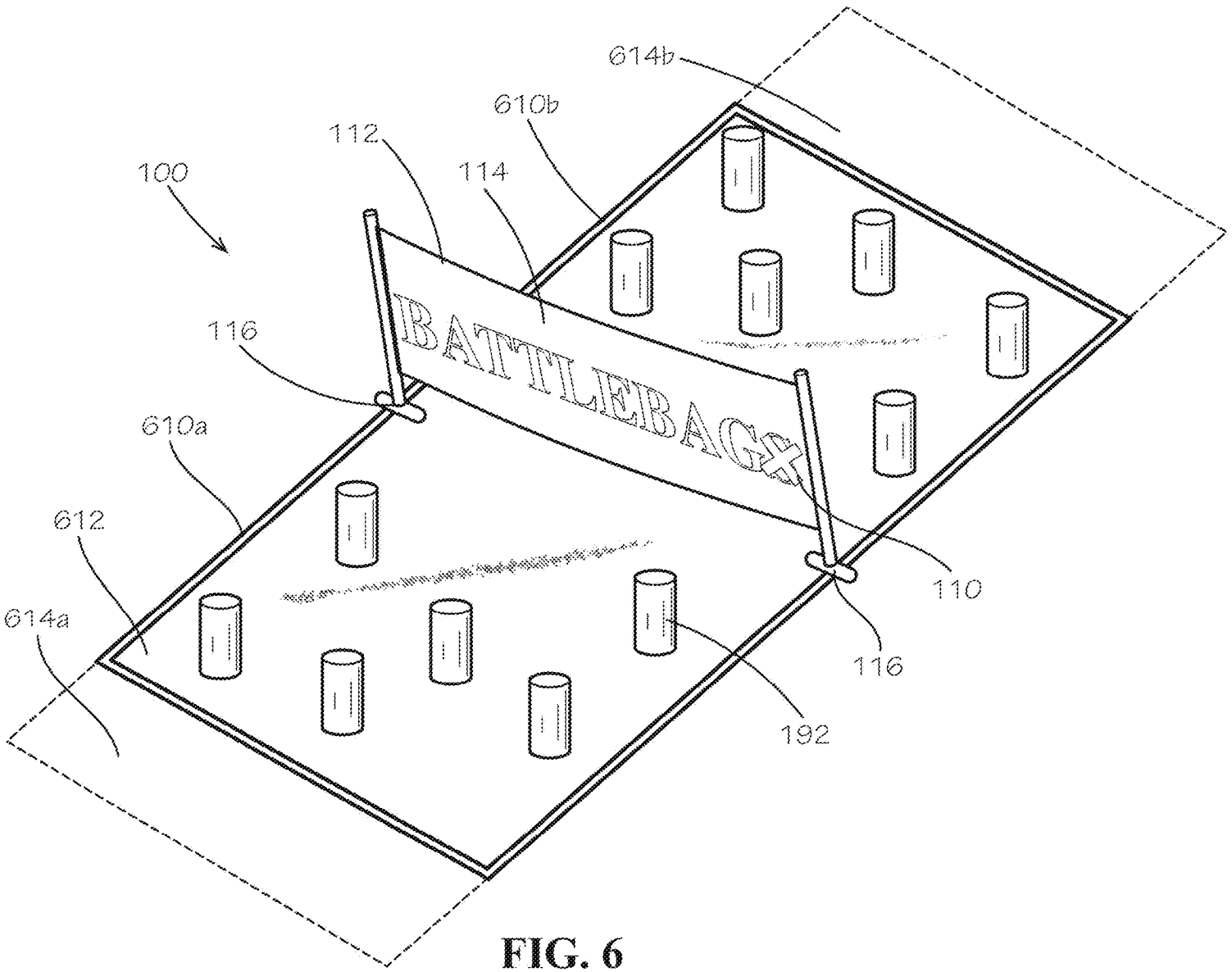
FIG. 6 is a perspective view of another aspect of the game in accordance with another aspect of the present disclosure.

The shield 110 can comprise a visibility screen 112 and a frame 116. In the present aspect, the visibility screen 112 can comprise a first sheet 114*a* and a second sheet 114*b*. In other aspects, the visibility screen 112 can comprise a single sheet, as shown in FIG. 6.

Returning to FIG. 1, the at least one projectile 180 can comprise four projectiles 182 in the current aspect. In other aspects, the at least one projectile 180 can comprise greater or fewer than four projectiles 182. In the present aspects, the projectiles 182 can be bean bags. In other aspects, the projectiles 182 can be a different type of object, such as a ball, ring, disc, horseshoe, or other suitable object.

The at least one target 190 can comprise twelve targets 192 in the current aspect. In other aspects, the at least one target 190 can comprise greater or fewer than twelve targets 192. In the present aspect, the targets 192 can each define a frustoconical shape; however, in other aspects, the targets 192 can define a different shape, such as a conical, cylindrical, pyramidal, or any other suitable shape. In the present aspect, the targets 192 can each be hollow or partially hollow, such that the targets 192 can be stacked atop one another to reduce required storage space, as shown.

Figure 2:
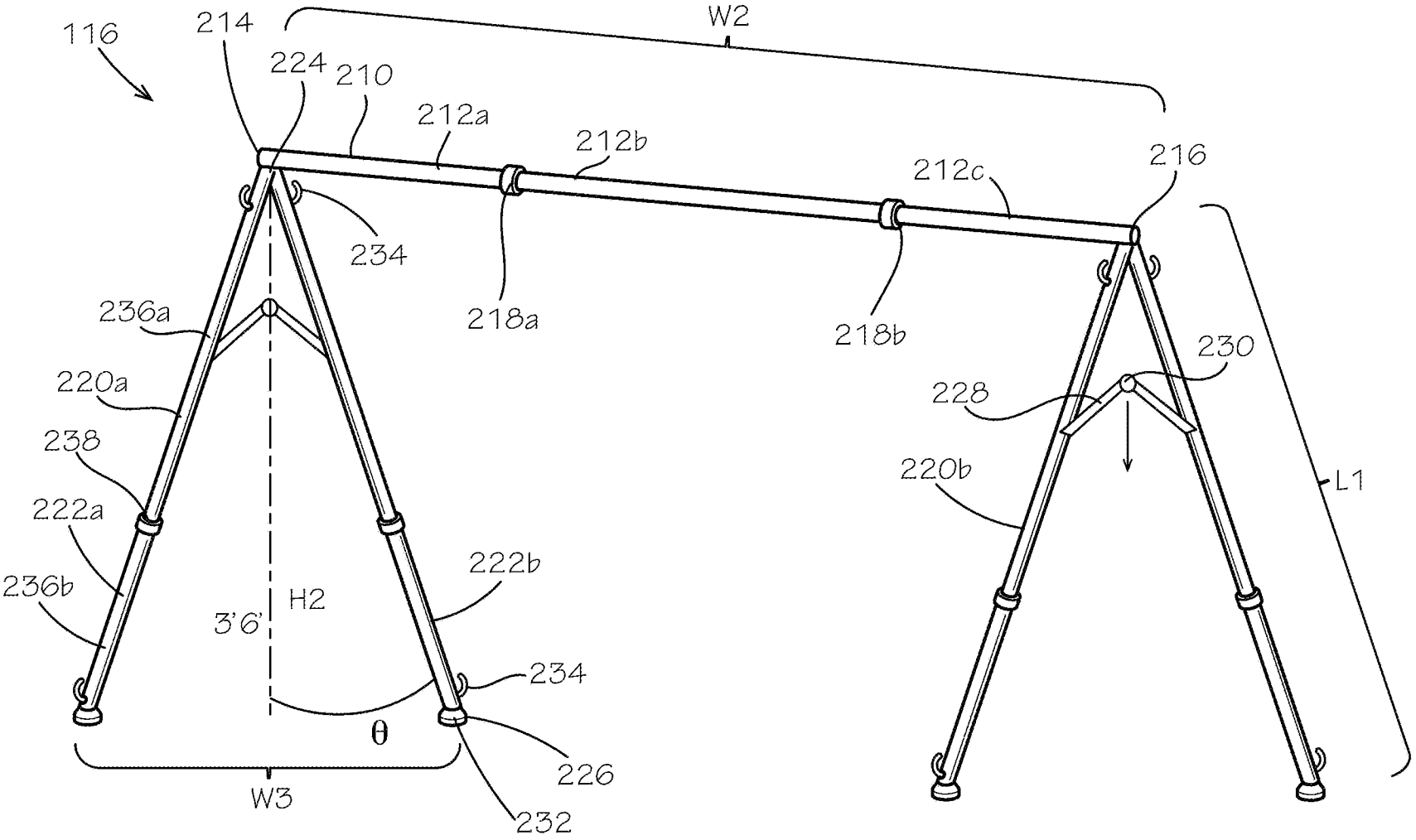
FIG. 2 is a perspective view of a frame of the shield of the game of FIG. 1, shown in a partially erected configuration.

FIG. 2 is a perspective view of the frame 116 of the game 100 of FIG. 1 shown in a partially erected configuration. Exemplary dimensions of the frame 116 are described below and are not intended to be limiting. Each of the dimensions shown can be larger or smaller than indicated. The dimensions shown can be optimized for a four-player aspect of the game. In aspects of the game 100 optimized for more than four players, the frame 116 can be larger. In particular, the frame 116 can be wider for aspects optimized for more than four players. The frame 116 can comprise a top bar 210 and a pair of leg assemblies 220*a,b*. In the present aspect, the pair of leg assemblies 220*a,b* can be substantially the same to one another.

The top bar 210 can define a first end 214 and a second end 216. The second end 216 can be defined opposite from the first end 214. A top bar width W2 can be defined between the first end 214 and the second end 216. In the aspect shown, the top bar width W2 can be 5'6", for example and without limitation. The top bar 210 can comprise multiple segments, which can be configured to telescope relative to one another to vary the top bar width W2. In the present aspect, the top bar 210 can comprise three segments 212*a, b,c* that telescope relative to one another. The top bar 210 can also comprise a pair of locking mechanisms 218*a,b*. Locking mechanism 218*a* can secure segments 212*a,b* to one another, and locking mechanism 218*b* can secure segments 212*b,c* to one another. In some aspects, the locking mechanisms 218*a,b* can be spring detents that can engage holes defined in the segments 212*a,b,c* to secure the segments 212*a,b,c* relative to one another. In some aspects, the locking mechanisms 218*a,b* can be compression fittings that can screw down to compress a frictional member, such as a rubber gasket, to secure the adjacent segments through frictional engagement. In other aspects, different types of locking mechanisms 218*a,b* can be utilized.

Leg assembly 220*a* can be coupled to the top bar 210 at or near the first end 214, and leg assembly 220*b* can be coupled to the top bar 210 at or near the second end 216. Referring to leg assembly 220*a*, which can be representative of leg assembly 220*b*, each leg assembly 220*a,b* can comprise a pair of legs 222*a,b*. As demonstrated by leg 222*b*, each leg 222*a,b* can define a top end 224 and a bottom end 226, and each leg 222*a,b* can comprise an attachment mechanism 234 positioned at or near the top end 224 and an attachment mechanism 234 positioned at or near the bottom end 226. In the present aspects, the attachment mechanisms 234 can be positioned within six inches of the top end 224 and bottom end 226 respectively. The attachment mechanisms 234 can be configured to couple the visibility screen 112 (shown in FIG. 4) to the frame 116, as shown in FIG. 4. For example, the first sheet 114*a* (shown in FIG. 4) can couple to the leg assemblies 220*a,b* on one side of the top bar 210, and the second sheet 114*b* (shown in FIG. 4) can couple to the leg assemblies 220*a,b* on the other side of the top bar 210, opposite form the first sheet 114*a*. Returning to FIG. 2, in the present aspect, the attachment mechanisms 234 can be hooks that can engage complimentary attachment mechanisms 334 (shown in FIG. 3) of the sheets 114*a,b*, such as grommets. In other aspects, a different attachment mechanism 234,334 can be utilized. For example and without limitation, the attachment mechanisms 234,334 can comprise snap fasteners (sometimes called "buttons"), hook-and-loop fasteners, lanyards, loops, tie-strings, magnets, or any other suitable fastening mechanism.

A foot 232, such as a rubber foot for example and without limitation, can be coupled to the bottom end 226 of each leg 222*a,b*. The feet 232 can comprise a high-friction material, such as a polymer or rubber, which can prevent the frame 116 from sliding along a ground surface. The feet 232 can also add weight to the frame 116 to prevent the frame 116 from overturning, such as if exposed to a high wind. In some aspects, the legs 222*a,b* can be hollow, and the feet 232 can be removable to permit the legs 222*a,b* to be filled with a heavy ballast material, such as sand, water, gravel, or other readily available materials. For example and without limitation, if the frame 116 is set up on a beach on a windy day, sand from the beach can be poured into the legs 222*a,b* to better resist the wind from toppling the frame 116, and the feet 232 can be removed to empty the sand from the legs 222*a,b* at the end of the day when breaking the frame 116 back down to the disassembled configuration.

The top ends 224 of the legs 222*a,b* can be coupled to the top bar 210, and the legs 222*a,b* can be configured to pivot relative to one another so that the bottom ends 226 can spread apart from one another, such as through utilization of a hinge mechanism. A leg width W3 can be defined between the bottom ends 226 of the legs 222*a,b* of each respective leg assembly 220*a,b*, and the leg width W3 can be varied by spreading the bottom ends 226 apart from one another. As shown by leg 222*b*, a leg angle θ can be defined between the bottom end 226 and a vertical direction. A frame height H2 of the frame 116 can be measured along the vertical direction. In the present aspect, the frame height H2 can be 3'6", for example and without limitation. As shown by leg 222*a*, each leg 222*a,b* can comprise a pair of segments 236*a,b* capable of telescoping relative to one another and a leg locking mechanism 238 for securing the segments 236*a,b* to one another to set the frame height H2, which can depend upon a leg length L1 of each leg 222*a,b*. In the present aspect, the leg length L1 can be 3'8", for example and without limitation. The telescoping and locking of the legs 222*a,b* can be similar to the telescoping and locking of the top bar 210. Once the sheets 114*a,b* are attached to the frame 116, as shown in FIG. 4, the legs 222*a,b* and top bar 210 can be slightly extended further through the telescoping action to snug the sheets 114*a,b* and pull them taught on the frame 116.

Returning to FIG. 2, as demonstrated by leg assembly 220*b*, each leg assembly 220*a,b* can further comprise a hinged locking linkage 228 extending between the legs 222*a,b* of the respective leg assembly 220*a,b*, which can be locked in place by pressing a center hinge 230 of the hinged locking linkage 228 downward until the hinged locking linkage 228 is in a linear configuration (shown in FIG. 4) rather than the angled configuration shown. With the hinged locking linkages 228 in the linear configuration, the leg assemblies 220*a,b* can be locked into an erected configuration, which is ready for use and prevents the legs 222*a,b* from hinging towards one another. In the erected configuration, the leg angle θ can be approximately 20-25 degrees. In other aspects, the leg angle θ can be larger or smaller than 20-25 degrees. For example, in some aspects, the leg angle θ can be between 10 and 45 degrees.

The hinged locking linkage 228 can be disengaged by pressing the center hinge 230 upwards to return the hinged locking linkage 228 to the angled configuration, wherein the legs 222*a,b* can be folded together. The locking mechanisms 218*a,b*,238 can then be unlocked and the top bar 210 and legs 222*a,b* of each leg assembly 220*a,b* collapsed via telescoping to return the frame 116 to the disassembled configuration. In some aspects, the leg assemblies 220*a,b* can also fold to be substantially parallel with the top bar 210, thereby further reducing storage space.

Figure 3:
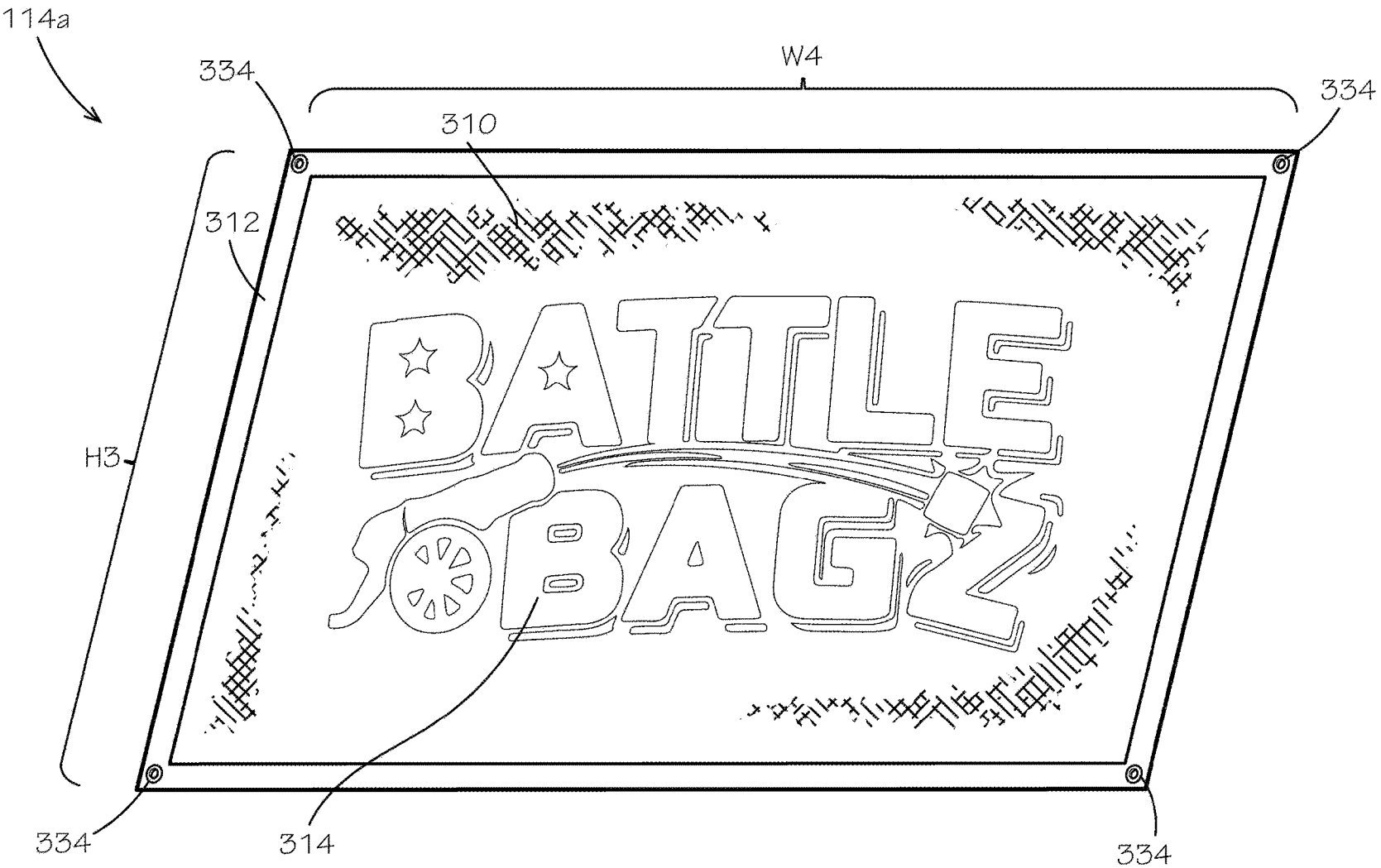
FIG. 3 is a perspective view of a first sheet of a visibility screen of the shield of the game of FIG. 1.
Figure 4:
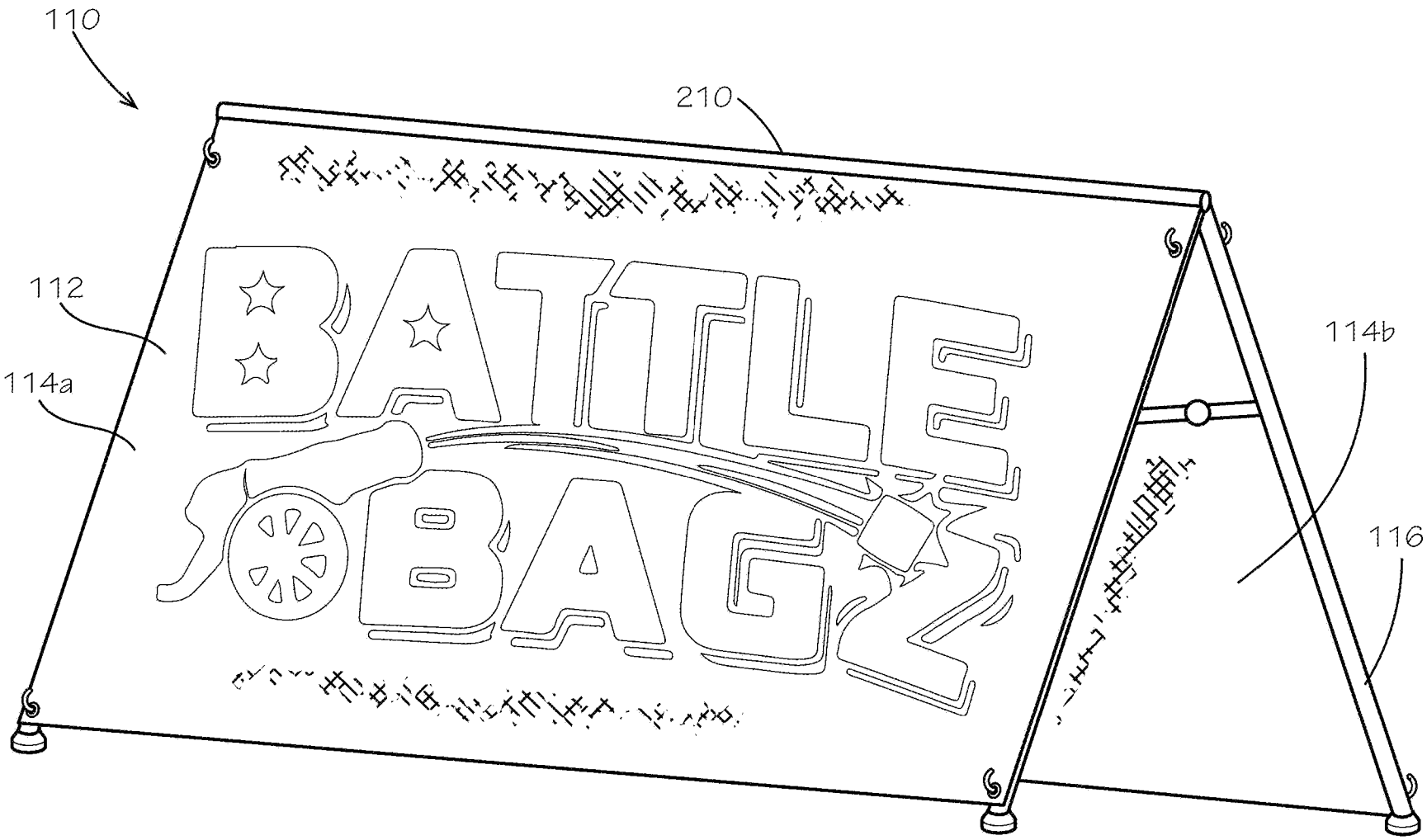
FIG. 4 is a perspective view of the shield of the game of FIG. 1 shown in an assembled configuration.

FIG. 3 is a perspective view of the first sheet 114*a* of the visibility screen 112 (shown in FIG. 1) of the game 100 of FIG. 1. The first sheet 114*a* can define a height H3 and a width W4. The height H3 can be 3'8", and the width W4 can be 5'6" in the aspect shown. These dimensions are merely exemplary, and the sheet 114*a,b* can be larger or smaller than shown. The first sheet 114*a* can be representative of the second sheet 114*b* (shown in FIG. 1) as well. The first sheet 114*a* can comprise a mesh center material 310 surrounded by a reinforced perimeter 312. The mesh center material 310 can be optimized so that the sheets 114*a,b* permit air to flow through them while being sufficiently opaque that a person cannot see through them. By permitting air to flow through them, wind forces blowing upon the sheets 114*a,b* can be reduced. In some aspects, the sheets 114*a,b* can define indicia 314. In the exemplary aspect, the indicia 314 can be a product logo for the game 100 (shown in FIG. 1). In other aspects, the indicia 314 can define advertisements, such as for promotional giveaways or for use at events. In other aspects, the indicia 314 can define a disorienting or camouflaged pattern so that the at least one target 190 (shown in FIG. 1) cannot be discerned through the sheets 114*a,b*.

The reinforced perimeter 312 can comprise a thicker material selected to give strength to the sheets 114*a,b*, such as to allow the sheets 114*a,b* to be pulled taught and to prevent tearing. The attachment mechanisms 334 can be coupled to the reinforced perimeter 312, and in the present aspect, the attachment mechanisms 334 can be positioned at corners of the sheets 114*a,b*. In other aspects, the sheet 114*a,b* can comprise additional attachment mechanisms 334 positioned along the reinforced perimeter 312 between the corners, and the frame 116 (shown in FIG. 2) can have additionally complimentarily positioned attachment mechanisms 234 (shown in FIG. 2).

FIG. 4 is a perspective view of the shield 110 of the game 100 of FIG. 1, shown in an assembled configuration. In the present aspect, the shield 110 can have an A-frame construction, and in the assembled configuration, the shield 110 can stand on its own and resist substantial wind forces. The weight of the frame 116 and feet 232 (shown in FIG. 2), the mesh center material 310 (shown in FIG. 3), and the leg angle θ (shown in FIG. 2) all contribute to the ability of the shield 110 to resist wind forces without moving or overturning. In some aspects, the shield 110 can also comprise loops or similar attachment points connected to the frame 116 or sheets 114*a,b* that can be configured to receive stakes, such as for staking the shield 110 down for high winds. The shield 110 can provide a visual barrier that can conceal the position of an opponent's at least one target 190 (shown in FIG. 4) when positioned on the opposite side of the shield 110, as shown in FIG. 5.

Figure 5:
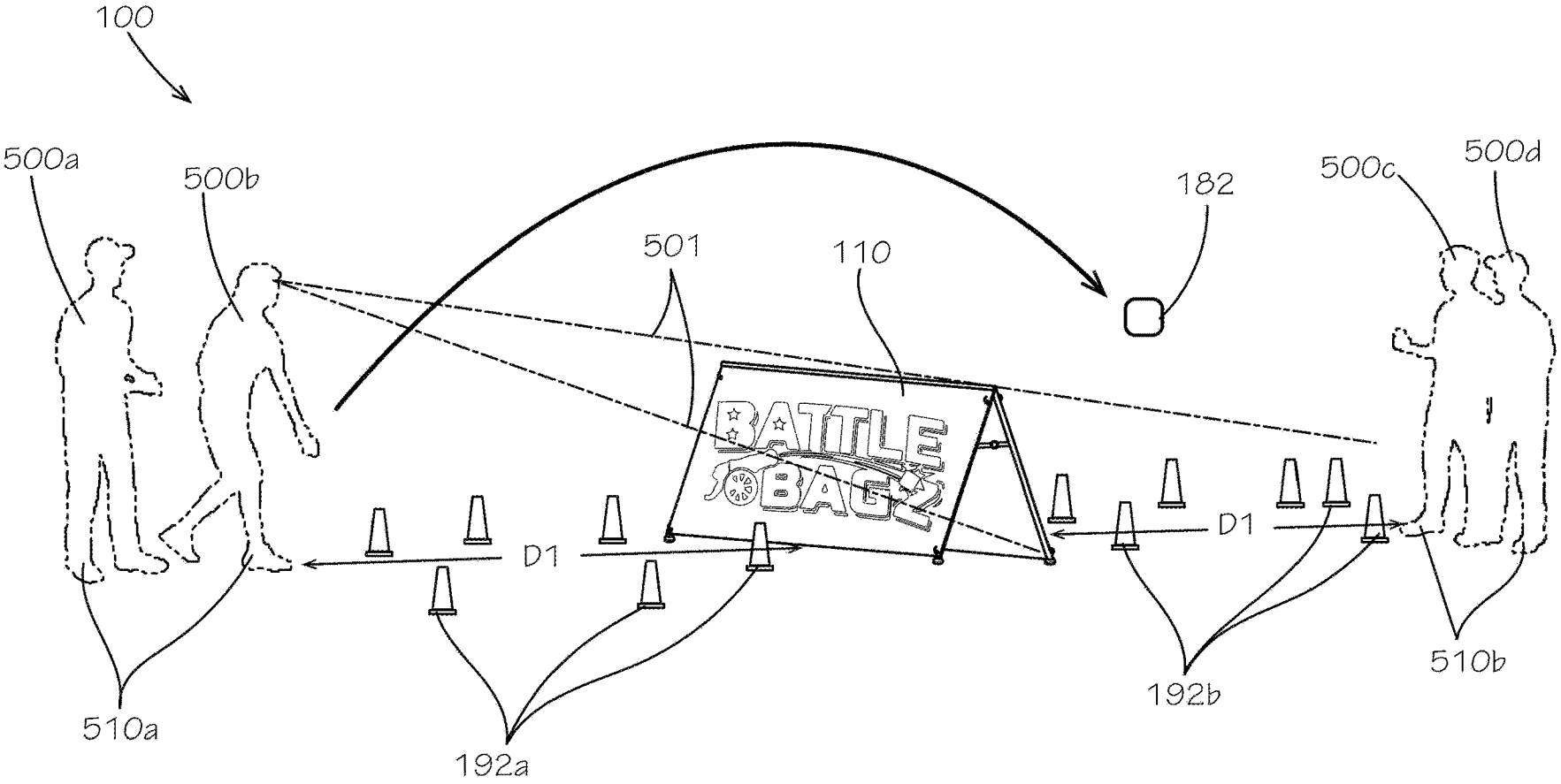
FIG. 5 is a side view of two teams and the game of FIG. 1 demonstrating a method of playing the game of FIG. 1 in accordance with another aspect of the present disclosure.

FIG. 5 demonstrates a method for playing the game 100 of FIG. 1. The game 100 can be played by as few as two players 500. In the current aspect, the game 100 can be played with four players 500*a,b,c,d*, as shown.

The game 100 can be played with two opposing sides, a first team 510*a* and a second team 510*b*. The opposing teams 510*a,b* can start on opposite sides of the shield 110, and in the current aspect, each team 510*a,b* can start with six targets 192 (192*a* denoting the targets of the first team 510*a*, 192*b* denoting the targets of the second team 510*b*. At the beginning of play, the method begins with a target setup step wherein each team 510*a,b* can arrange their respective targets 192*a,b* however they want within a respective target box 610*a,b* (shown in FIG. 6) of the team 510*a,b*. With one exception described below, the targets 192 may not be relocated by the players 500*a,b,c,d* for the remainder of the game after the target setup step. In the current aspect, the target box 610*a,b* can be equal in width with the shield 110 (equivalent to the top bar width W2 shown in FIG. 2) and have a depth D1. The depth D1 can be equal to roughly six feet or two paces back from the shield 110 in length. For a more advanced variation, a longer length, or depth D1, such as nine feet for example and without limitation, can be used to provide a larger target box 610*a,b*. During the target setup step, each team 510*a,b* may not look at the opposing team's targets 192*a,b* in the current aspect of the game 100.

Once the target setup step is complete, each team 510*a,b* can then assume a position standing behind their team's targets 192*a,b* (each team's respective targets 192*a,b* and the target box 610*a,b* are positioned between the team 510*a,b* and the shield 110). When standing behind the targets 192*a,b* and target box 610*a,b* in a respective throwing position 614*a,b* (show in FIG. 6), the shield 110 can be sized tall enough and wide enough to prevent each team 510*a,b* from seeing the opposing team's targets 192*a,b*. In other words, the shield 110 can be sized and positioned to block the line of sight of each player 500*a,b,c,d* of the target box 610*a,b* and targets 192*a,b* of the opposing team 510*a,b*. This is demonstrated in FIG. 5 by a line of sight 501 of player 500*b*, which shows that the shield 110 is positioned within the line of sight 501 of player 500*b* between player 500*b* and both the targets 192*b* and target box 610*b*, thereby obstructing player 500*b* in seeing the targets 192*b* and target box 610*b*.

Upon the first turn, each player 500*a,b* of the first team 510*a* can begin holding two projectiles 182 per person, and each player 500*a,b* of the first team 510*a* can throw both of their projectiles 182 at the opposing team's targets 192*b*, as demonstrated by player 500*b*, before that team's turn is exhausted. The objective of the game 100 can be to knock over all of the opposing team's targets 192*a,b* with the projectiles 182 before the opposing team 510*a,b* knocks over all of your team's targets 192*a,b*.

Because the shield 110 blocks the view of the opposing team's targets 192*a,b*, the first throw can be completely blind; however, after each throw, the opposing team 510*a,b* must provide the throwing player with "proximity feedback," which requires the opposing team to tell the throwing player how close the projectile 182 landed to the nearest target 192. As depicted, either player 500*c* or player 500*d* will tell player 500*b* how close the projectile 182 landed to the closest target 192*b*. In some aspects, such as variants designed for less skilled or experienced players, the proximity feedback may also include a directional feedback component in addition to a distance feedback component (ex: "it landed six inches to the right," "you threw a foot too short," etc). In more advanced variations, the proximity feedback may be categorical, such as "hot" for projectiles 182 landing within six inches of a target 192, "warm" for projectiles 182 landing between six inches and two feet from a target 192, and "cold" for anything beyond two feet, for example and without limitation. In the event that the projectile 182 hits and knocks over one of the opposing team's targets 192*a,b*, that target 192 is pulled from the target box 610*a,b*. The players 500*a,b* of the first team 510*a* then can throw their remaining three projectiles 182 attempting to hone in on one or more targets 192 based on the proximity feedback provided after each throw. In another aspect, after the target setup step, players 500*a,b,c,d* can have a brief period, such as 30 seconds for example and without limitation, to look at the opposing team's targets 192*a,b* and then players 500*a,b,c,d* can throw their projectiles 182 from memory for the rest of the game 100. In such aspects, players 500*a,b,c,d* may not receive proximity feedback after throws.

In the current aspect, there is no required order in which the players 500*a,b* must take their turns, which can have strategic implications. In the current aspect, if the same player 500 knocks over a different target 192 with each of his/her thrown projectiles 182 in the same turn, then that player is awarded both of his/her projectiles 182 back and gets to have two more throws. This can be repeated so long as that player 500*a,b,c,d* does not miss on either of the additional awarded throws. For example and without limitation, if player 500*b* knocks over a target 192*b* with his/her first thrown projectile, the first team 510*a* may then strategically elect to have player 500*a* throw both of his/her projectiles 182 to try to gather more information on the location of another target 192*b* in hopes that player 500*b* can then knock over that target 192*b* with his/her second projectile 182. Doing so would earn player 500*b* two additional throws in the same turn. In other aspects, the players 500*a,b* of the first team 510*a* can be required to follow a specific playing order, such as taking turns or one player 500*a* takes both turns and then the second player 500*b* takes both turns.

Once the first team 510*a* has exhausted all of their throws (including any additional throws awarded as described above), the second team 510*b* can take their turn in the same manner as described for the first team 510*a*. Once one team

510*a,b* has knocked over all of the opposing team's targets 192*a,b*, the team 510*a,b* with no targets 192*a,b* remaining can have a chance to "rebut" in the current aspect of the game 100, wherein the team 510*a,b* with no remaining targets 192*a,b* standing gets one last turn of two throws per player 500 of that team 510*a,b* and must knock over all of the opposing team's remaining targets 192*a,b* to escape defeat. If they successfully do so, the game 100 can go to an additional overtime round. In the current aspect, each team 510*a,b* only places one new target 192*a,b* for the overtime round, and overtime rounds can repeat under the rebuttal rules.

As shown and commonly known, thrown projectiles 182 travel in an arcing path. The shield 110 can be specifically designed so that it is only a shield to visibility, not a complete physical shield to targets 192. The leg angle θ (shown in FIG. 2) can be specifically selected so that targets placed immediately adjacent to the shield 110 can still be struck by the projectiles 182 based on the angle of the sheets 114*a,b* (shown in FIG. 5), such as by throwing with a high, lofting arc. In the current aspect, players 500*a,b,c,d* can be permitted to throw their projectiles 182 so that the projectiles 182 land on the shield 110 and slide down the opposite side to hit the opposing team's targets 192*a,b* when placed at the foot of the shield 110. Additionally, in the current aspect, a team's 510*a,b* own targets can be knocked over by its own players 500*a,b,c,d* to that team's 510*a,b* detriment. Accordingly, placing targets 192 at the base of the shield 110 can be risky because a poorly thrown projectile 182 that does not make it over the shield 110 may slide down and knock over the team's 510*a,b* own targets 192.

In other variations of the game, rather than knocking over the targets 192, the projectile 182 may be thrown into the target 192. For example, in some aspects, the targets 192 can be positioned with the open side facing upwards, and a projectile 182, such as a ball, can be thrown with the object of landing it inside the target 192. In some aspects, the game 100 can be played with libations, including alcoholic beverages, poured into the targets 192 wherein players 500*a,b,c,d* must drink the libation if an opposing player 500*a,b,c,d* lands a projectile 182 into the target 192. In such aspects, light balls such as table tennis balls can be used as projectiles 182. Alternatively, sealed beverages can be used for the targets 192. For example and without limitation, cans or bottles of soft drinks, beer, or other beverages can be utilized as targets 192, and when a target 192 is knocked over by a projectile 182, a player for the team 510*a,b* must drink the contents before their team's turn. In other aspects, rings or horseshoes can be used as projectiles 182 and thrown with the purpose of landing the projectile 182 around a portion of the target 192 rather than tipping the target 192 over. In such aspects, the targets 192 can be rods or similarly shaped objects to be driven into the ground. In the current aspect, the game 100 can be played on any type of ground surface, including paved areas, lawns, beaches, indoor floor surfaces, or any other suitable surface.

FIG. 6 is a perspective view of another aspect of the game 100 in accordance with another aspect of the present disclosure. In the aspect shown, the shield 110 can be a vertical barrier instead of the A-frame style shield 110 shown in FIG. 4. In such an aspect, the visibility screen 112 can comprise a single sheet 114. The frame 116 can comprise a pair of posts 116, and the visibility screen 112 can extend between them. In the aspect shown, the game 100 can further comprise a floormat 612 that visually indicates the target boxes 610*a,b*. In some aspects, the floormat 612 can have a grid or other indicia to aid in measuring the distance of the projectile 182 (shown in FIG. 1) from the nearest target 192 for providing more accurate proximity feedback. In aspects with a floormat 612, distances for proximity feedback can be estimated, and the players 500*a,b,c,d* can simply remain aware of the boundaries of the target boxes 610*a,b*. As shown, the targets 192 can be cylindrical in shape.

Target box 610*a* can be a first target box 610*a* of the first team 510*a* (shown in FIG. 5), and target box 610*b* can be a second target box 610*b* of the second team 510*b* (shown in FIG. 5). A first team throwing position 614*a* can be positioned behind the first target box 610*a*, and a second team throwing position 614*b* can be positioned behind the second target box 610*b*. With the exception of retrieving projectiles 182 (shown in FIG. 5) from the target boxes 610*a,b*, the throwing positions 614*a,b* can be where the players 500*a,b,c,d* (shown in FIG. 5) of the game 100 respectively stand throughout the game 100 to prevent viewing of the opposing team's target box 610*a,b* during the game 100, as described above with respect to FIG. 5. While retrieving projectiles 182 from the target boxes 610*a,b*, players 500*a,b,c,d* can be on the "honor system" not to cheat by looking over the shield 110. In the current aspect, if a player 500*a,b,c,d* accidentally views an opposing team's target 192, the player 500*a,b,c,d* must confess, and the team 510*a,b* whose target 192 was viewed may relocate that target 192 before the game 100 continues.

Figure 10:
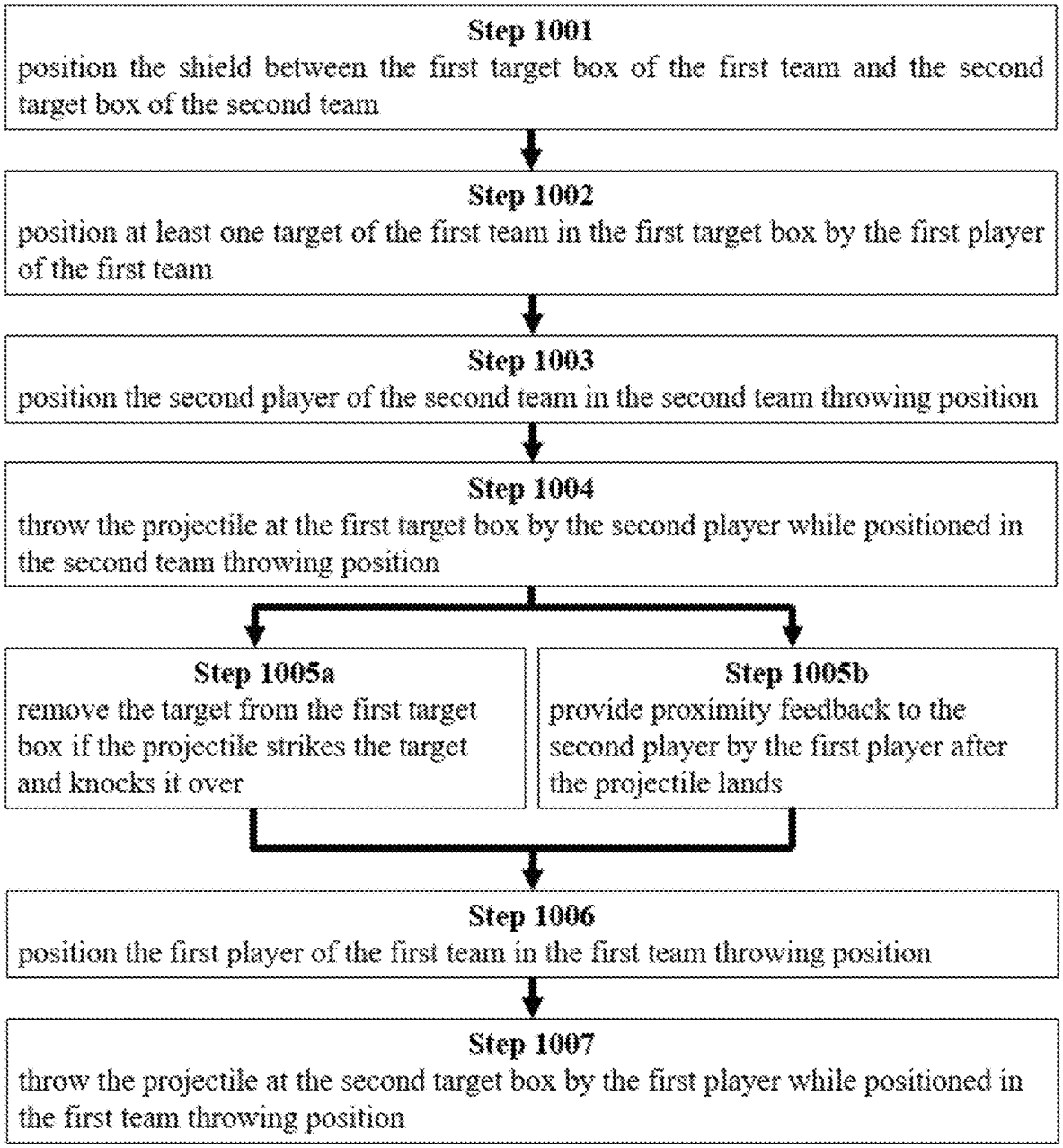
FIG. 10 is a flow chart demonstrating a method of playing the game of FIG. 1 in accordance with another aspect of the present disclosure.

FIG. 10 is a flow chart demonstrating an exemplary method of playing the game of FIG. 1 in accordance with the present disclosure. In step 1001 of the method, the shield can be positioned between the first target box of the first team and the second target box of the second team. In step 1002, at least one target of the first team can be positioned in the first target box by a first player of the first team in a target setup step. The target setup step, can optionally comprise positioning the at least one target of the second team in the second target box of the second team. In step 1003, the second player of the second team can be positioned in the second team throwing position, wherein the second player can be positioned behind the second target box of the second team, the shield can be positioned between the second player and the first target box, and the shield can block the line of sight of the second player from seeing the first target box and the at least one target of the first team. In step 1004, the projectile of the at least one projectile can be thrown at the first target box by the second player while positioned in the second team throwing position.

A target of the at least one target of the first team can optionally be removed from the first target box if the projectile strikes the target and knocks it over, as shown by step 1005*a*. Optionally, proximity feedback can be provided to the second player by the first player after the projectile lands, as demonstrated by step 1005*b*. The proximity feedback can define a distance that the projectile landed from a nearest target of the at least one target of the first team. The proximity feedback can optionally define a directional component describing where the projectile landed relative to the nearest target of the at least one target of the first team. As shown in step 1006, the method can optionally comprise positioning the first player of the first team in a first team throwing position, wherein the first player can be positioned behind the first target box of the first team, the shield can be positioned between the first player and the second target box, and the shield can block a line of sight of the first player from seeing the second target box and the at least one target of the second team. As shown by step 1007, the method can optionally comprise throwing the projectile of the at least one projectile at the second target box by the first player while positioned in the first team throwing position.

Figure 7:
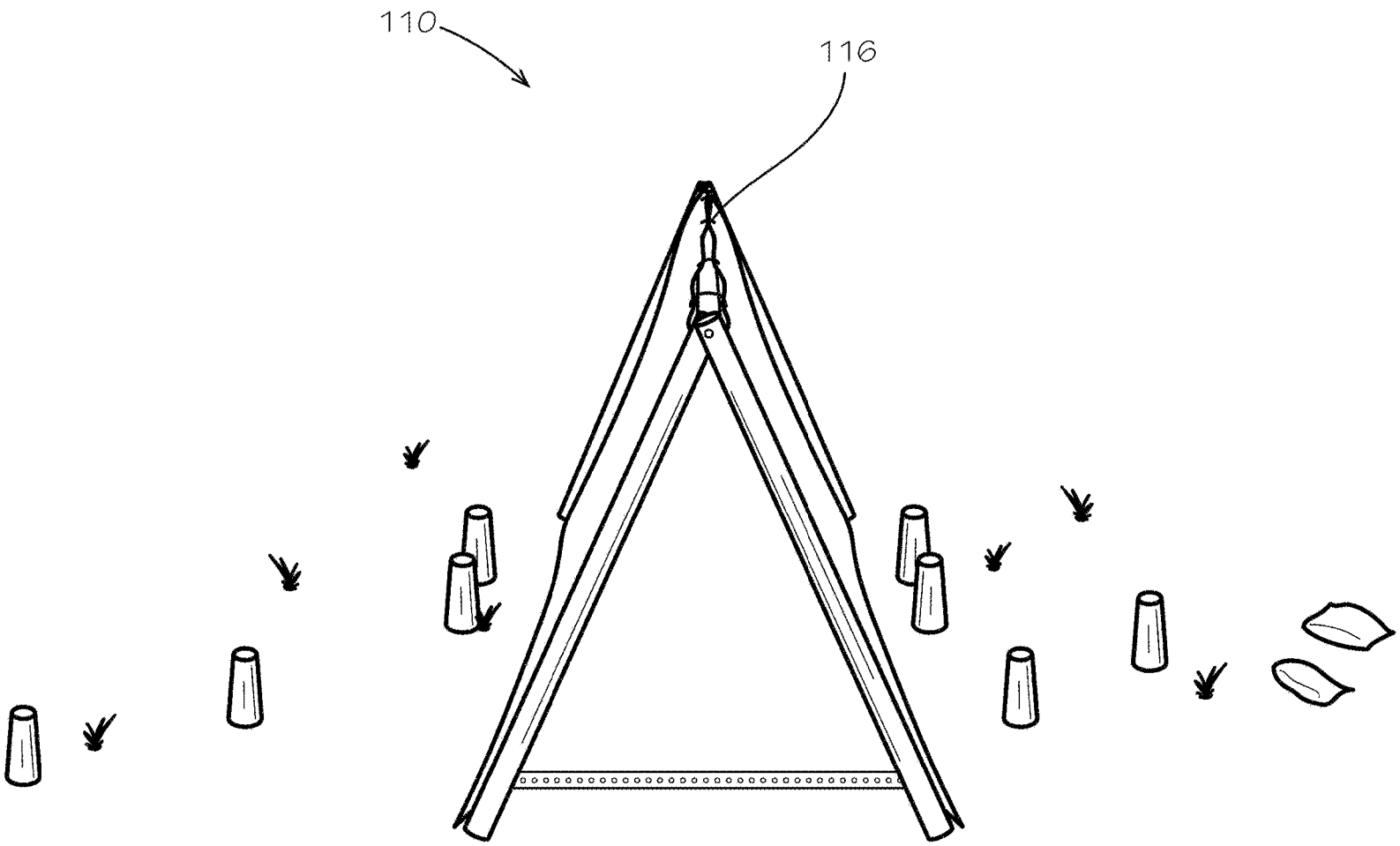
FIG. 7 is a side view of another aspect of the shield in accordance with another aspect of the present disclosure.
Figure 8:
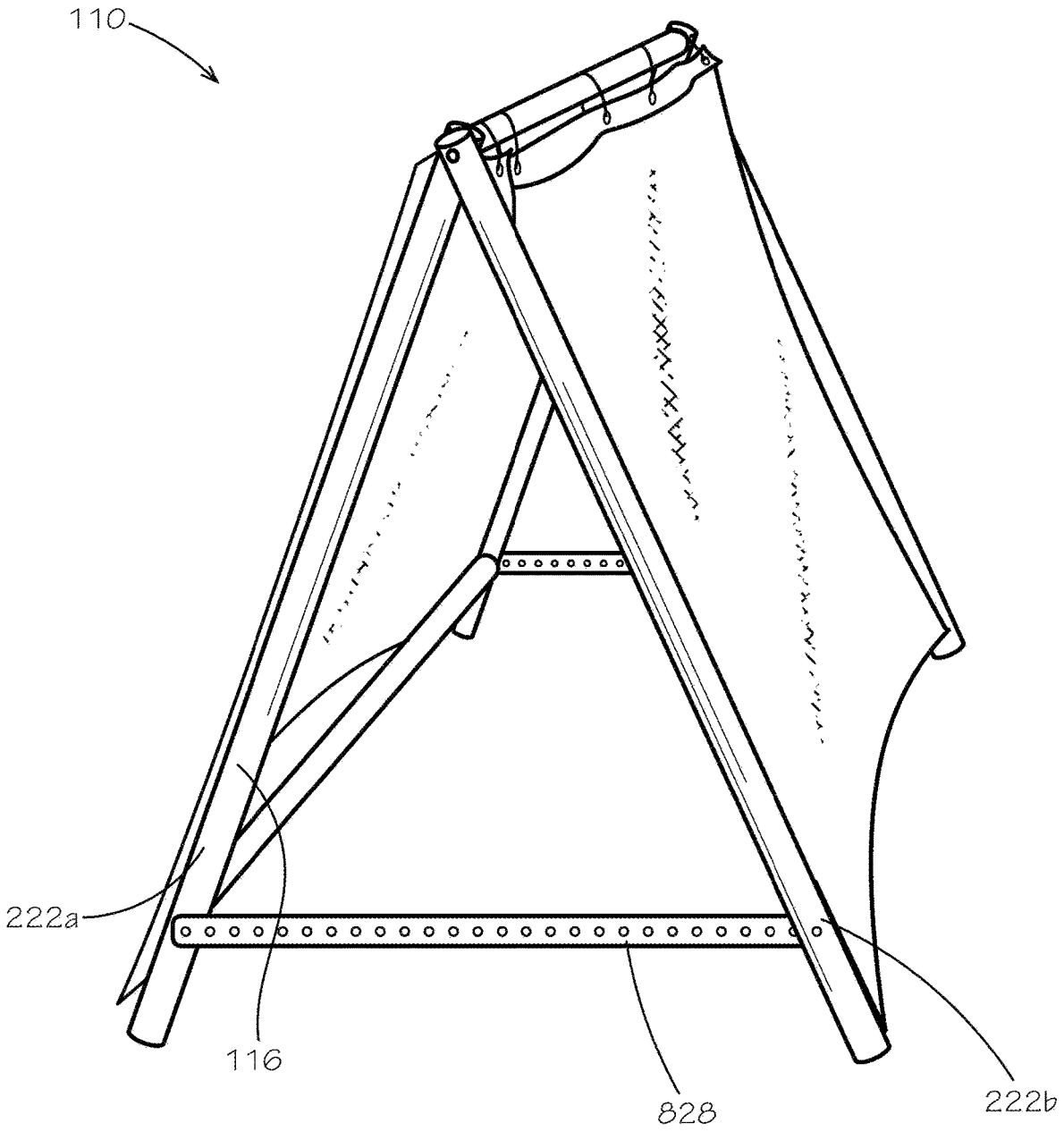
FIG. 8 is a side view of the shield of FIG. 7.

FIGS. 7 and 8 are side views of another aspect of the shield 110 in accordance with another aspect of the present disclosure. In the aspects shown, the frame 116 can comprise rigid members that are not configured to telescope. As shown in FIG. 8, the frame 116 can comprise a rigid crossbar 828 to lock the legs 222*a,b* in the erected configuration shown. In the aspect shown, the legs 222*a,b* can be folded together to collapse the frame 116 by disengaging the rigid crossbar 828 from one or both of the legs 222*a,b*.

Figure 9:
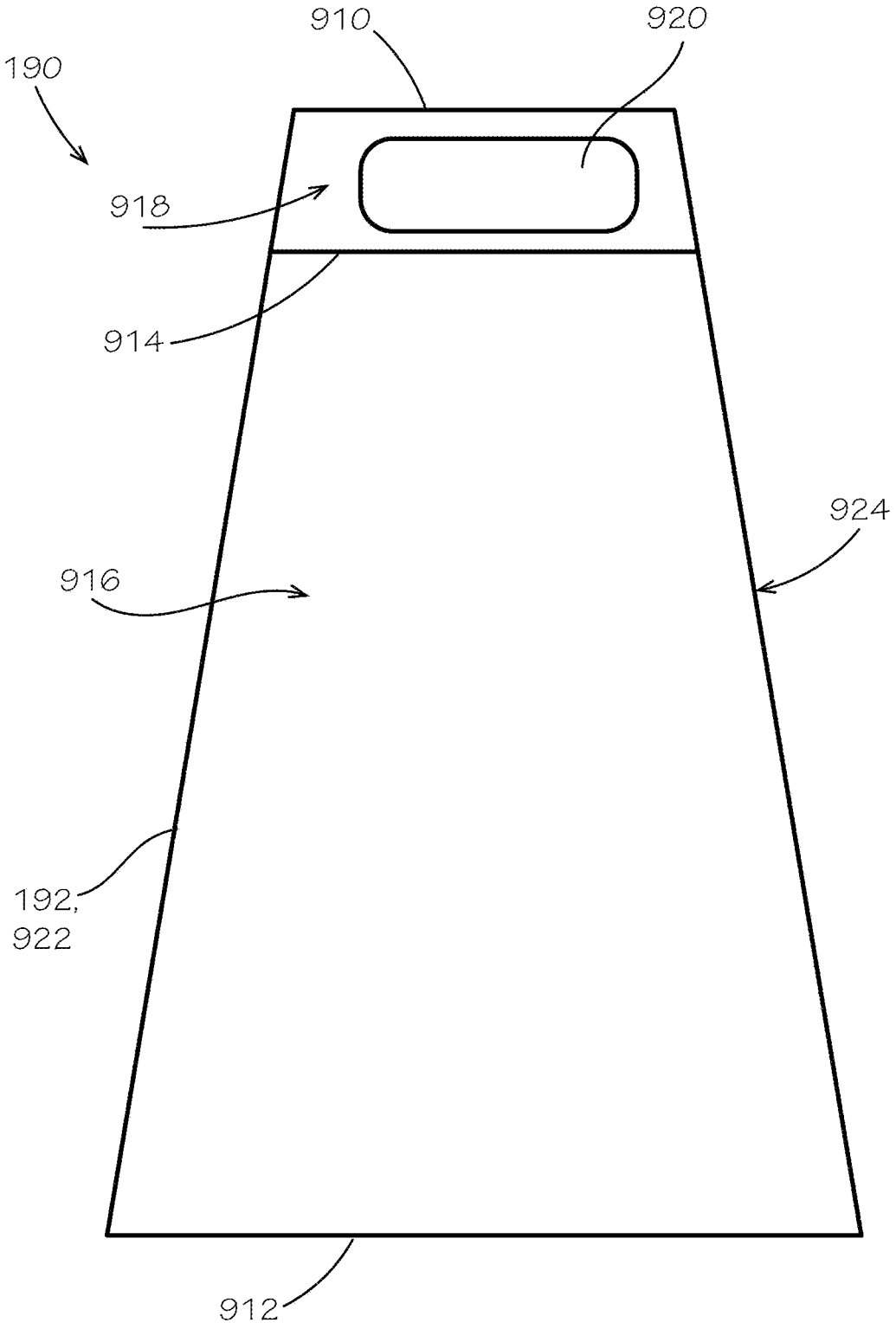
FIG. 9 is a cross-sectional view of another aspect of a target of the at least one target in accordance with another aspect of the present disclosure.

FIG. 9 is a cross-sectional view of another aspect of the target 192 of the at least one target 190 in accordance with another aspect of the present disclosure. In the present aspect, each target 192 of the at least one target 190 can comprise a noisemaker 920 and a body 922. The body 922 can define a top end 910 and a bottom end 912. The body 922 can define a side surface 924 extending from the top end 910 to the bottom end 912. The bottom end 912 can be open, and a target cavity 916 can extend into the body 922 of the target 192 from the bottom end 912 towards the top end 910.

As shown, the body 922 of each target 192 can define a false bottom 914 positioned between the top end 910 and the bottom end 912, and a noisemaker cavity 918 can be defined between the top end 910 and the false bottom 914. In some aspects, the top end 910 and the bottom end 912 can be integrally formed by the body 922 of the target 192, and the false bottom 914 can be a separate component positioned within the target cavity 916, thereby partitioning off a portion of the target cavity 916 as the separate noisemaker cavity 918. In other aspects, the false bottom 914 can be integrally formed by the body 922 of the target 192 with the noisemaker cavity 918 being defined as a separate cavity extending inwards from the top end 910 to the false bottom 914. In such aspects, the bottom end 912 can be a separate component put in place to enclose the noisemaker cavity 918. In still other aspects, the top end 910 and portions of the sidewall adjacent to it can be a separate component that couples to the false bottom 914 of the target 192.

The noisemaker 920 of the target 192 can be positioned within the noisemaker cavity 918. The noisemaker 920 can be configured to emit an audible sound in response to a triggering event, such as the target 192 being knocked onto its side surface 924, to provide auditory feedback that the target 192 has been knocked over during gameplay. At least mechanical, electronic, and electromechanical aspects of the noisemaker 920 are contemplated. For example and without limitation, in a mechanical aspect, the noisemaker 920 can comprise one or more non-powered mechanical noisemakers, such as bells, that are configured to chime or sound in response to the triggering event, such as when the target 192 receives a substantial jolt, or impact, from the projectile 182 (shown in FIG. 1) or is toppled. In an electronic aspect, the noisemaker 920 can comprise a gravitational detection mechanism, such as a tilt switch for example and without limitation, a power supply, such as a battery for example and without limitation, and a speaker. When the target 192 is toppled, the gravitational detection mechanism can complete a circuit, and the speaker can generate a noise. In some aspects, the electronic aspect can further comprise a processor capable of playing songs or conveying messages through the speaker. In an electromechanical aspect, the noisemaker 920 can be similar in design to the electronic aspect, with the addition (or substitution) of an electromechanical noisemaker, such as a buzzer, percussive chime, or other suitable device.

In both electronic and electromechanical aspects, it can be desirable for the noisemaker 920 to further comprise an on/off switch that is accessible external to the noisemaker cavity 918, so that the noisemaker 920 can be turned on and off when not in use. For example and without limitation, a switch or button extending through the top end 910 or false bottom 914 can be utilized to turn the noisemaker 920 on and off between uses to prevent inadvertent noisemaking in storage or during transportation.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A method for playing a game comprising:

positioning a shield of the game between a first target box of a first team and a second target box of a second team, the game further comprising at least one target of the first team and at least one projectile;

positioning the at least one target of the first team in the first target box by a first player of the first team in a target setup step;

positioning a second player of the second team in a second team throwing position wherein:

the second player is positioned behind the second target box of the second team;

the shield is positioned between the second player and the first target box; and the shield blocks a line of sight of the second player from seeing the first target box and the at least one target of the first team; and throwing a projectile of the at least one projectile at the first target box by the second player while positioned in the second team throwing position.

2. The method of claim 1, further comprising providing a proximity feedback to the second player by the first player after the projectile lands, the proximity feedback defining a distance that the projectile landed from a nearest target of the at least one target of the first team.

3. The method of claim 2, wherein the proximity feedback further defines a directional component describing where the projectile landed relative to the nearest target of the at least one target of the first team.

4. The method of claim 1, further comprising removing a target of the at least one target of the first team from the first target box if the projectile strikes the target and knocks it over.

5. The method of claim 1, wherein:

the game further comprises at least one target of the second team; and target setup step further comprises positioning the at least one target of the second team in the second target box of the second team.

6. The method of claim 5, further comprising:

positioning the first player of the first team in a first team throwing position wherein:

the first player is positioned behind the first target box of the first team;

the shield is positioned between the first player and the second target box; and the shield blocks a line of sight of the first player from seeing the second target box and the at least one target of the second team; and throwing the projectile of the at least one projectile at the second target box by the first player while positioned in the first team throwing position.

7. The method of claim 1, wherein the projectile is a bean bag.

* * * * *